US006397394B1

(12) United States Patent
Hambly

(10) Patent No.: US 6,397,394 B1
(45) Date of Patent: Jun. 4, 2002

(54) TOOL GRIPPING ASSEMBLY

(76) Inventor: Joseph R. Hambly, 906 Michael La., Amherst, OH (US) 44001

( * ) Notice: Subject to any disclaimer, the term of this patent is extended or adjusted under 35 U.S.C. 154(b) by 0 days.

(21) Appl. No.: 09/747,888

(22) Filed: Dec. 26, 2000

(51) Int. Cl.[7] ..... A41D 19/00
(52) U.S. Cl. ..... 2/160; 2/161.8
(58) Field of Search ..... 2/161.1, 161.2, 2/161.6, 159, 160, 161.3, 161.8, 917; 16/421

(56) References Cited

U.S. PATENT DOCUMENTS

| | | | | |
|---|---|---|---|---|
| 3,368,811 | A | * | 2/1968 | Finney |
| 3,508,280 | A | * | 4/1970 | Osborn |
| 3,532,344 | A | * | 10/1970 | Masstab |
| 3,885,249 | A | | 5/1975 | De Brabander |
| 4,270,228 | A | * | 6/1981 | Gaiser |
| D268,968 | S | | 5/1983 | Sami |
| 4,682,691 | A | * | 7/1987 | Spiering |
| 4,691,387 | A | * | 9/1987 | Lopez |
| 4,947,573 | A | * | 8/1990 | Bischoff |
| 4,977,621 | A | | 12/1990 | Richard |
| 5,031,640 | A | | 7/1991 | Spitzer |
| 5,184,827 | A | | 2/1993 | Suttle et al. |
| 5,236,223 | A | * | 8/1993 | Leon et al. |
| 5,347,684 | A | * | 9/1994 | Jackson |
| 5,348,360 | A | * | 9/1994 | Mencarelli et al. |
| 5,454,380 | A | | 10/1995 | Gates |

FOREIGN PATENT DOCUMENTS

| | | | |
|---|---|---|---|
| GB | 2080672 | * | 2/1982 |

* cited by examiner

*Primary Examiner*—Rodney M. Lindsey

(57) ABSTRACT

A tool gripping assembly for making it easier and more comfortable for a user to hold a tool especially a dangerous tool such as a welding torch. The tool gripping assembly includes a glove having a wrist portion and a hand portion including a thumb member and finger members; and also includes a fastening member being securely attached to the glove; and further includes a tool fastening strip member being adapted to be attached about a tool and being fastenable to the fastening member.

1 Claim, 2 Drawing Sheets

TOOL GRIPPING ASSEMBLY

BACKGROUND OF THE INVENTION

1. Field of the Invention

The present invention relates to a tool gripper and more particularly pertains to a new tool gripping assembly for making it easier and more comfortable for a user to hold a tool especially a dangerous tool such as a welding torch.

2. Description of the Prior Art

The use of a tool gripper is known in the prior art. More specifically, a tool gripper heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,885,249; U.S. Pat. No. 5,184,827; U.S. Pat. No. Des. 268,968; U.S. Pat. No. 5,031,640; U.S. Pat. No. 4,977,621; and U.S. Pat. No. 5,454,380.

While these devices fulfill their respective, particular objectives and requirements, the aforementioned patents do not disclose a new tool gripping assembly. The inventive device includes a glove having a wrist portion and a hand portion including a thumb member and finger members; and also includes a fastening member being securely attached to the glove; and further includes a tool fastening strip member being adapted to be attached about a tool and being fastenable to the fastening member.

In these respects, the tool gripping assembly according to the present invention substantially departs from the conventional concepts and designs of the prior art, and in so doing provides an apparatus primarily developed for the purpose of making it easier and more comfortable for a user to hold a tool especially a dangerous tool such as a welding torch.

SUMMARY OF THE INVENTION

In view of the foregoing disadvantages inherent in the known types of tool gripper now present in the prior art, the present invention provides a new tool gripping assembly construction wherein the same can be utilized for making it easier and more comfortable for a user to hold a tool especially a dangerous tool such as a welding torch.

The general purpose of the present invention, which will be described subsequently in greater detail, is to provide a new tool gripping assembly which has many of the advantages of the tool gripper mentioned heretofore and many novel features that result in a new tool gripping assembly which is not anticipated, rendered obvious, suggested, or even implied by any of the prior art tool gripper, either alone or in any combination thereof.

To attain this, the present invention generally comprises a glove having a wrist portion and a hand portion including a thumb member and finger members; and also includes a fastening member being securely attached to the glove; and further includes a tool fastening strip member being adapted to be attached about a tool and being fastenable to the fastening member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool gripping assembly which has many of the advantages of the tool gripper mentioned heretofore and many novel features that result in a new tool gripping assembly which is not anticipated, rendered obvious, suggested, or even implied by any of the prior art tool gripper, either alone or in any combination thereof.

It is another object of the present invention to provide a new tool gripping assembly which may be easily and efficiently manufactured and marketed.

It is a further object of the present invention to provide a new tool gripping assembly which is of a durable and reliable construction.

An even further object of the present invention is to provide a new tool gripping assembly which is susceptible of a low cost of manufacture with regard to both materials and labor, and which accordingly is then susceptible of low prices of sale to the consuming public, thereby making such tool gripping assembly economically available to the buying public.

Still yet another object of the present invention is to provide a new tool gripping assembly which provides in the apparatuses and methods of the prior art some of the advantages thereof, while simultaneously overcoming some of the disadvantages normally associated therewith.

Still another object of the present invention is to provide a new tool gripping assembly for making it easier and more comfortable for a user to hold a tool especially a dangerous tool such as a welding torch.

Yet another object of the present invention is to provide a new tool gripping assembly which includes a glove having a wrist portion and a hand portion including a thumb member and finger members; and also includes a fastening member being securely attached to the glove; and further includes a tool fastening strip member being adapted to be attached about a tool and being fastenable to the fastening member.

Still yet another object of the present invention is to provide a new tool gripping assembly that prevents the onset of carpal tunnel syndrome since the user would not have to grip the tool as hard.

Even still another object of the present invention is to provide a new tool gripping assembly that makes sure that the user doesn't lose one's hold on the tool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
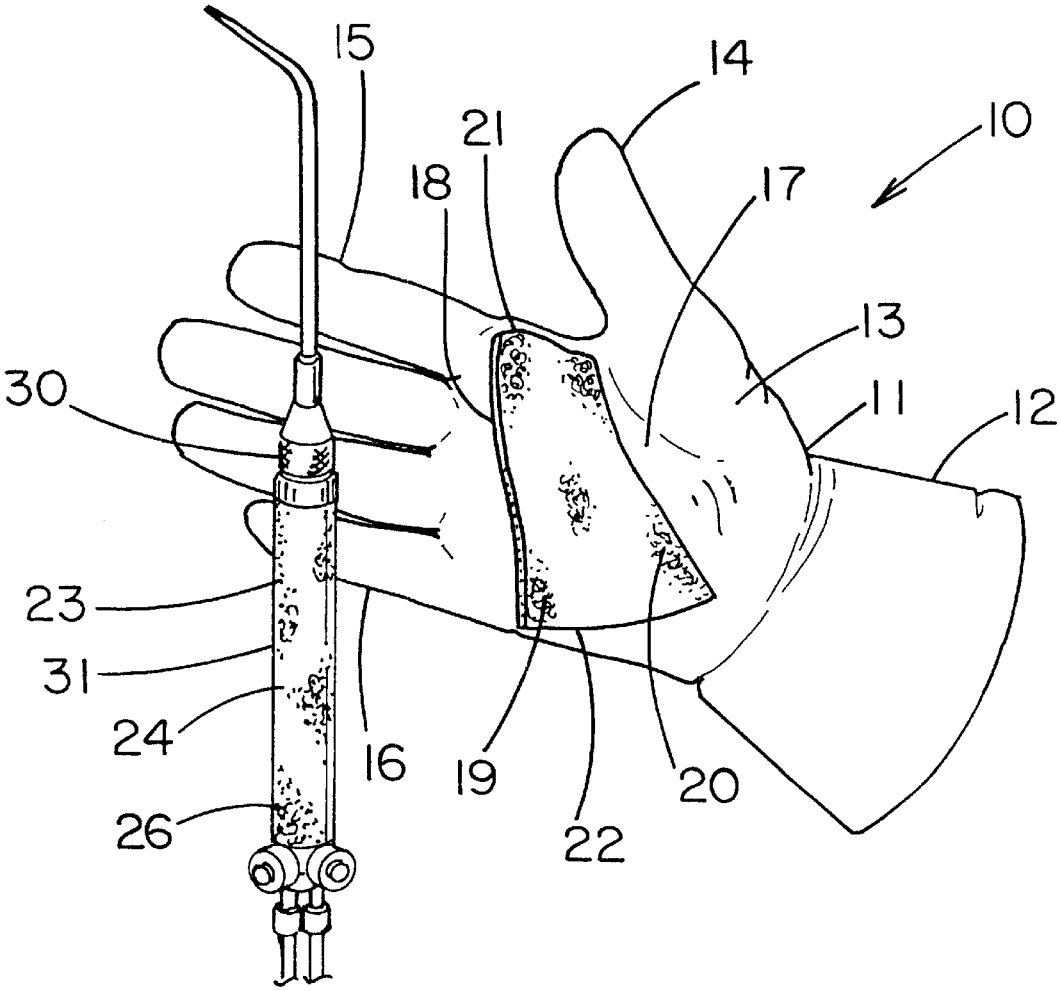
FIG. 1 is a perspective view of a new tool gripping assembly according to the present invention and shown in use.
Figure 2:
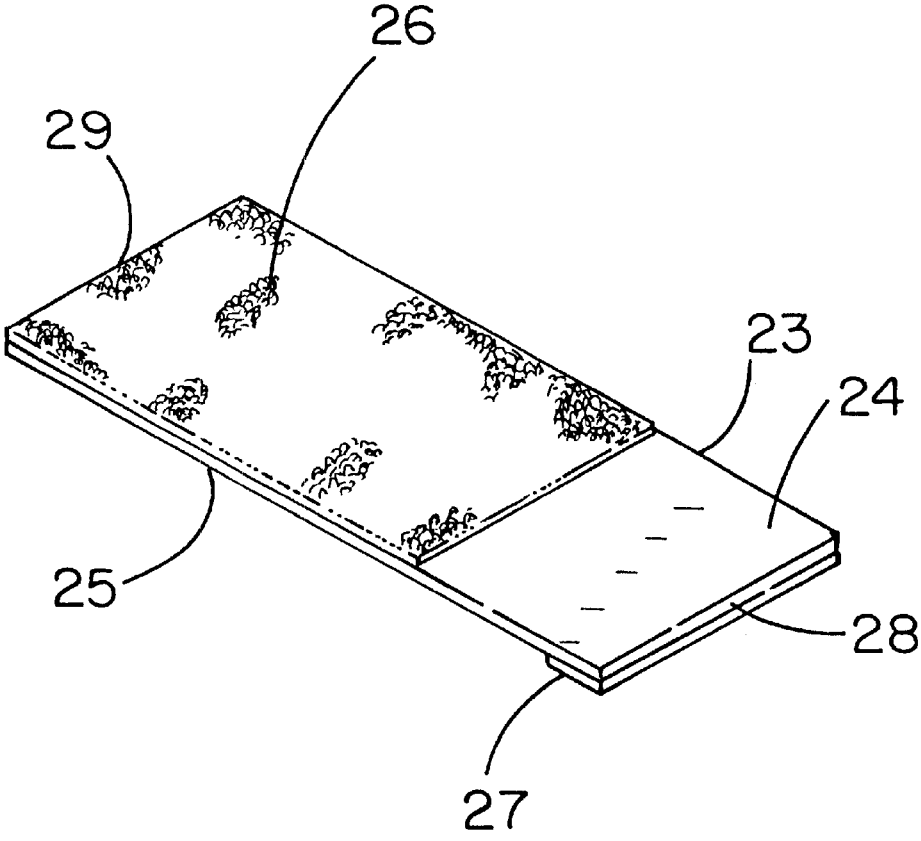
FIG. 2 is a perspective view of the tool fastening strip member of the present invention.

With reference now to the drawings, and in particular to FIGS. 1 through 2 thereof, a new tool gripping assembly embodying the principles and concepts of the present invention and generally designated by the reference numeral 10 will be described.

As best illustrated in FIGS. 1 through 2, the tool gripping assembly 10 generally comprises a glove 11 having a wrist portion 12 and a hand portion 13 including a thumb member 14 and finger members 15,16. A fastening member 18 is securely and conventionally attached and sewn to the glove 11. The fastening member 18 is a strip of material having a plurality of hook and loop fasteners 20 being conventionally disposed upon a top side 19 thereof. The strip of material 18 is securely and conventionally attached across a palm 17 of the glove 11 and extends from one side of the glove 11 to the other side of the glove 11. The strip of material 18 includes a first end 21 which is attached between a base of the thumb member 14 and a base of an index finger member 15 of the glove 11, and also includes a second end 22 which is attached between a base of a pinky finger member 16 and a heel of the palm 17 of the glove 11. The strip of material 18 is flared outwardly from the first end 21 to the second end 22.

A tool fastening strip member 23 is adapted to be attached about a tool 30 and is fastenable to the fastening member 18. The tool fastening strip member 23 includes a top side 24 and a back side 25 with hook and loop fasteners 26 being conventionally disposed upon the top side 24 thereof and with a strip of adhesive 27 being conventionally disposed upon an end portion 28 of the back side 25 thereof for fastening the end portion 28 to an opposite end portion 29 of the tool fastening strip member 23 about a handle 31 of the tool 30. The hook and loop fasteners 26 of the tool fastening strip member 23 is fastenable to the hook and loop fasteners 20 of the fastening member 18.

In use, the user slips the glove upon one's hand and grasps the tool 30 with the glove 11 with the hook and loop fasteners 20 of the fastening member 18 fastening to the hook and loop fasteners 26 of the tool fastening strip member 23 for the user to securely hold onto the tool 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool gripping assembly comprising:

a glove having a wrist portion and a hand portion including a thumb member and finger members;

a fastening member being securely attached to said glove, said fastening member being a strip of material having a plurality of hook and loop fasteners being disposed upon a top side thereof, said strip of material being securely attached across a palm of said glove and extending from one side of said glove to the other side of said glove, said strip or material including a first end which is attached between a base or said thumb member and a base of an index finger member of said glove, and also including a second end which is attached between a base of a pinky finger member and a heel of said palm of said glove, said strip of material being flared outwardly from said first end to said second end such that the fastening member lies upon the center of the palm between bendable portions of a thumb and a pinky finger; and a tool fastening strip member being adapted to be attached about a tool and being fastenable to said fastening member, said tool fastening strip member including a top side and a back side with hook and loop fasteners being disposed upon said top side thereof and with adhesive being disposed upon an end portion of said back side thereof for fastening said end portion to an opposite end portion of said tool fastening strip member about a handle of the tool, said hook and loop fasteners of said tool fastening strip member being fastenable to said hook and loop fasteners of said fastening member.

* * * * *